US006119435A

United States Patent [19]

Fujiwara et al.

[11] Patent Number: 6,119,435

[45] Date of Patent: Sep. 19, 2000

[54] TAPE ATTACHER

[75] Inventors: Takayuki Fujiwara; Kunihiro Sumida; Kazuo Okutsu, all of Kanagawa, Japan

[73] Assignee: Fuji Photo Film Co., Ltd., Kanagawa, Japan

[21] Appl. No.: 09/251,147

[22] Filed: Feb. 17, 1999

Related U.S. Application Data

[62] Division of application No. 08/911,032, Aug. 14, 1997, Pat. No. 5,921,067.

[30] Foreign Application Priority Data

Aug. 14, 1996 [JP] Japan ..... 8-214702

[51] Int. Cl.[7] ..... B65B 41/14

[52] U.S. Cl. ..... 53/389.3; 53/389.2; 53/136.5; 53/139.1

[58] Field of Search ..... 53/583, 139.1, 53/136.3, 136.4, 136.5, 389.1, 389.2, 389.3; 493/116, 117

[56] References Cited

U.S. PATENT DOCUMENTS

| | | | |
|---|---|---|---|
| 2,196,666 | 4/1940 | Moore . | |
| 2,890,554 | 3/1959 | Dolman et al. . | |
| 2,894,363 | 7/1959 | Voogd | 53/389.2 X |
| 3,037,335 | 6/1962 | Smith | 53/586 |
| 3,150,477 | 9/1964 | Keene . | |
| 3,206,911 | 9/1965 | Carle et al. . | |
| 3,313,089 | 4/1967 | Rustad et al. . | |
| 3,328,938 | 7/1967 | Mack . | |
| 3,535,189 | 10/1970 | Hall et al. | 53/586 X |
| 3,546,045 | 7/1967 | Califano et al. | 53/586 X |
| 3,738,081 | 6/1973 | Heinzer . | |

(List continued on next page.)

FOREIGN PATENT DOCUMENTS

| | | |
|---|---|---|
| 310673 | 1/1956 | Germany . |
| 38-7673 | 3/1961 | Japan . |
| 55-13976 | 4/1980 | Japan . |
| 55-23922 | 6/1980 | Japan . |
| 58-44525 | 10/1983 | Japan . |
| 60-55364 | 12/1985 | Japan . |
| 61-44725 | 10/1986 | Japan . |
| 2-19223 | 1/1990 | Japan . |
| 3-176344 | 7/1991 | Japan . |
| 7-41895 | 5/1995 | Japan . |
| 7-64326 | 7/1995 | Japan . |
| 7-67922 | 7/1995 | Japan . |
| 7-108689 | 11/1995 | Japan . |
| 865639 | 4/1961 | United Kingdom . |
| 1 472 609 | 5/1977 | United Kingdom . |
| WO 95/18748 | 7/1995 | WIPO . |

*Primary Examiner*—Daniel B. Moon

*Attorney, Agent, or Firm*—Sughrue, Mion, Zinn, Macpeak & Seas, PLLC

[57] ABSTRACT

A pillow type packaging apparatus has a suction belt for conveying flexible continuous sheet material. A guide unit guides the continuous sheet material being conveyed, and forms the continuous sheet material into a quadrangular tube in which a pair of its longitudinal edges are confronted with each other. A center sealer thermally seals up the longitudinal edges. An inserter inserts an article into the tube through the guide unit. The tube is formed into a packaging bag by cutting and sealing. In the guide unit, an inner guide frame is inside an outer guide frame. The outer guide frame includes first to fourth corner portions, which are disposed in a quadrangular shape, have inside edges in contact with the continuous sheet material, and shape the continuous sheet material into the tube. The first to fourth corner portions are movable in directions of width and height of the continuous sheet material. The tube is changeable in a size. The inner guide frame includes fifth to eighth corner portions, which respectively correspond the first to fourth corner portions, are disposed in a quadrangular shape, contact the continuous sheet material, and maintain the continuous sheet material shaped in the tube inside the first to fourth corner portions. The fifth to eighth corner portions are movable in the directions of the width and height with respective distances therefrom to the first to fourth corner portions kept unchanged.

1 Claim, 16 Drawing Sheets

U.S. PATENT DOCUMENTS

| | | | |
|---|---|---|---|
| 3,762,283 | 10/1973 | Renner | 53/136.4 X |
| 3,783,585 | 1/1974 | Hoyland | 53/583 |
| 3,859,062 | 1/1975 | Okubo et al. . | |
| 4,052,240 | 10/1977 | Luhman et al. | 493/117 X |
| 4,106,265 | 8/1978 | Aterianus . | |
| 4,430,844 | 2/1984 | James . | |
| 4,658,569 | 4/1987 | Hanagata . | |
| 4,679,379 | 7/1987 | Cassoli . | |
| 4,761,937 | 8/1988 | Francioni . | |
| 4,873,815 | 10/1989 | Tetenborg et al. . | |
| 5,614,042 | 3/1997 | Nishide et al. | 53/137.2 X |
| 5,687,544 | 11/1997 | Watabe et al. | 53/136.5 |
| 5,730,827 | 3/1998 | Sewell | 53/136.4 X |

TAPE ATTACHER

This is a divisional of application Ser. No. 08/911,032 filed Aug. 14, 1997, U.S. Pat. No. 5,921,067 the disclosure of which is incorporated herein by reference.

BACKGROUND OF THE INVENTION

1. Field of the Invention

The present invention relates to a pillow type packaging apparatus. More particularly, the present invention relates to a pillow type packaging apparatus capable of packaging an article efficiently with agreeable appearance without fail, typically in a manner of a gusseted bag.

2. Description Related to the Prior Art

A pillow type packaging apparatus operates to wrap an article into a bag or packaging by use of continuous sheet material, to obtain a package. In the packaging operation, the outer form of the article is also obtained by way of an auxiliary guide member for the tube forming to keep a tubular shape of the packaging bag. If a shape of a tube forming guide unit as viewed in cross section is different from that of the article as viewed in cross section, it is extremely difficult to obtain the package with agreeable appearance. Also it is extremely difficult without the article to form the packaging bag being empty in a desired size. When supply of the article is stopped, for example, for changing the size and shape of the packaging bag, it is required to supply a dummy article to stabilize the tube forming operation. Even if there is an unusable or unacceptable portion in the continuous sheet material such as a connected portion, it is difficult to remove the unusable part of the continuous sheet material from the apparatus without the article. It is necessary to wrap the article, remove the article from the unusable packaging bag, and then wrap the article again.

JP-Y 38-7673 and JP-Y 55-23922 disclose a use of an inner guide frame, which is disposed inside the tube forming guide unit, for guiding the continuous sheet material inside its tubular portion.

When the continuous sheet material used for the packaging operation is highly rigid, for example 100 microns or more thick, a problem arises by shortening a tube forming distance to deform the continuous sheet material in an abrupt manner. Fine wrinkles (called "darts") occur on the continuous sheet material, to increase resistance to tube forming remarkably. JP-A 63-272607 (corresponding to U.S. Pat. No. 4,761,937) suggests solution of this problem. The tube forming resistance is reduced by disposing a roller or arcuate member in a bending position in the tube forming guide unit for bending the continuous sheet material.

This idea has a shortcoming in that a path length of the continuous sheet material in a width direction between a position before the tube forming guide unit and a position after it is not regular. The term "path length" herein is used to represent a length of a locus of the continuous sheet material being sent through the tube forming guide unit. Thus tension of the continuous sheet material in the width direction is irregular. Possibility of occurrence of zigzag movement of the continuous sheet material is high. The continuous sheet material, typically with low resiliency, does not run smoothly even by use of the roller or arcuate member. Wrinkles may occur more frequently. If the tube forming guide unit has a curved portion, it is difficult to maintain similarity of a shape of the guide unit after a change in the size to its shape before the change.

In general, a tube forming distance is determined sufficiently in the apparatus for the tube forming of the continuous sheet material with low resiliency. This is because the difference in the path length of the continuous sheet material along in the width of the continuous sheet material between upstream and downstream positions from the tube forming guide unit should be absorbed, even though the continuous sheet material has a low tendency of extension and compression.

In the pillow type packaging apparatus, the article should be supplied to the tube forming guide unit while positioned at a regular interval, article from article, for the purpose of preventing the article from colliding with a bottom sealer. There are suggestions for this positioning, which have been implemented in practical use. JP-B 58-44525 (corresponding to JP-A 54-138792) discloses a mechanical construction for positioning each article by use of a pusher. JP-B 7-67922 (corresponding to JP-A 4-44912) discloses an electric construction according to which a sensor is disposed directly before the tube forming guide unit, and a supply conveyor is started in response to a signal from the sensor.

The continuous sheet material after the tube forming for the tubular shape is subjected to a station of gusset forming shortly before the bottom sealer. In the gusset forming, lateral faces of the continuous sheet material are folded inward. The continuous sheet material is collapsed and flattened in a vertical direction, to discharge air from between two consecutive articles. JP-B 7-108689 (corresponding to JP-A 2-282004) discloses gusset forming in which the bottom sealer is used by way of a tube forming guide unit. The bottom sealer is moved, for example, according to a technique of the box motion.

There is a problem in that a conveyor, which conveys the article being packaged, is likely to interfere with the bottom sealer. JP-B 7-64326 (corresponding to JP-A 2-282005) suggests a solution, according to which the conveyor is extended and shortened. A conveyor belt unit consists of upstream and downstream conveyor sections, in which a common single belt is connected in a roll form. The belt roll is horizontally moved to change an interval between upstream and downstream conveyor sections. An interval between the conveyor sections is increased for allowing heaters above and below a conveying path to operate for the center sealing, and changed as zero (0) in a closed state with the heaters retracted vertically from the conveying path.

JP-Y 38-7673 and JP-Y 55-23922 disclose the inner guide frame, which, however, is changeable in the size only in the width direction of the packaging bag. No suggestion exists for an inner guide frame changeable in the size in a vertical direction of the packaging bag. In changing the size of the tube forming guide unit, the tube forming state should be adjusted while the continuous sheet material is manually supplied by an operator. The pillow type packaging apparatus known so far in the art is comparatively unadvantageous in comparison with other types of packaging apparatus, because of low suitability to changing the size of the continuous sheet material.

It is important that the tube forming guide unit should have a shape with a constant path length between upstream and downstream positions from the tube forming guide unit in any position of the continuous sheet material in its width direction, to prevent looseness in forming the continuous sheet material into the tubular shape. JP-B 60-55364 (corresponding to JP-A 58-64908) discloses an example of a shape of the tube forming guide unit. However the tube forming guide unit has a continuous surface. If the size of the packaging bag is required to change, the tube forming guide unit must be entirely exchanged or deformed.

In the known apparatuses, the inner guide frame is only inserted in an opening of the tube forming guide unit. There occurs looseness in the packaging bag in association with a gap between the tube forming guide unit and the inner guide frame. It is likely that tightness in the bottom sealed portion becomes low due to wrinkles caused in the gusset forming. It is likely that there occurs failure in the gusset forming such as deviations between a folded line of gussets and any of four lateral edges of the packaging bag.

The above-mentioned apparatus with the tube forming distance being great has an inevitably great size. If an accident occurs in the tube forming guide unit, it is extremely difficult to pass the continuous sheet material in the packaging apparatus initially for next operation. It is also necessary to remove a considerable number of inserted test articles from the line, and insert dummy articles to stabilize the forming of the packaging bag before safely starting the packaging operation.

JP-B 58-44525 (corresponding to JP-A 54-138792) and JP-B 7-67922 (corresponding to JP-A 4-44912) suggest the positioning method of an interval between articles with prevention of collision between the article and the bottom sealer. However it is difficult to check the article in the tube forming guide unit for exactness in the regular interval in the arrangement. If an operator manually adjusts the apparatus for eliminating difficulties in the tube forming guide unit, collision may occur again in the article and the bottom sealer resulting in drawbacks of the known method. The interval between the articles changes depending upon a height of the article. The packaging apparatus suitable for plural sizes has a difficulty in positioning the article at a suitable interval again upon restarting of the apparatus after the operator's adjustment.

JP-B 7-108689 (corresponding to JP-A 2-282004) has a shortcoming in that the packaging bag is the more difficult to produce according to a height of the packaging bag. More continuous sheet material than required is used. To effect the above-mentioned box motion, a relevant mechanism must have a complicated structure due to synchronization between conveyance of the article and movement of the bottom sealer.

A gusseted portion should be formed by bending four faces of the continuous sheet material of the tubular shape with bender members swingable about their respective axes. The respective axes of the bender members are not positioned along sides of an end face of the article according to any of the known constructions, and do not form a gusseted portion with agreeable appearance. Also, known bender members are likely to damage the continuous sheet material.

If a considerable amount of air remains in the packaging bag, the continuous sheet material must be used to, a greater extend. It is difficult to stabilize a packaging operation. To reduce this surplus amount of the continuous sheet material, there is a suggestion for a suction nozzle to be inserted into the tube forming guide unit to discharge the remaining air from the article. However it is difficult to adapt this suggestion to packaging an article not quadrangular as viewed in cross section.

JP-B 7-64326 (corresponding to JP-A 2-282005) discloses a use of a conveyor belt for conveying the article and an extensible structure for the conveyor belt. However this idea cannot be applied to a use of an accumulate conveyor. It is general to use a method of preventing interference with the bottom sealer by shifting the conveyor. However the conveyor of the shiftable type requires spaces in forward and reverse directions for shifting stroke. It is impossible at the same time to effect reception and delivery of the articles, so that cycle time becomes excessively-long, and inconsistent to heightening efficiency.

In the pillow type packaging apparatus where the packaging bag is supplied and the article is inserted into the packaging bag before a bag mouth of the packaging bag is closed, the closing operation is influenced by the article, the remaining air or the like. It is difficult to close the bag mouth of the packaging bag in the same state as before opening the bag mouth without difference. Typically with the gusseted bag, a process is required for folding the gusseted portion inwards in closing the packaging bag.

There are suggestions to solve this problem. JP-B 7-41895 (corresponding to JP-A 5-330518) discloses a use of force of suction for retaining the packaging bag. JP-B 52-29672 (corresponding to U.S. Pat. No. 3,859,062) discloses an operation of squeezing the bag mouth with a chuck. However the former has a shortcoming due to small force of retention with the suction. The latter must have a complicated mechanical structure for the chuck. Another shortcoming is a relatively great number of packaging steps because of insertion of the chuck into the packaging bag.

JP-B 61-44725 (corresponding to JP-A 55-134003) discloses a method in which the chuck squeezes the bag mouth, and rotates and moves toward the article for creating a folded end. The rotation and movement of the chuck are synchronized by engagement of a rack and a pinion.

If the chuck of the plate shape is used for folding the bag mouth, the chuck must be moved along a path of a sine curve when the chuck is rotated at a constant speed. It is impossible to keep tension applied to the continuous sheet material during the folding operation of the bag mouth. The bag mouth cannot be folded tightly typically when the article is fragile with small rigidity, or has an edge liable to be damaged.

If excessive tension is applied to the continuous sheet material for the purpose of tight folding, air is likely to enter the bag mouth to expand the packaging bag after the end folding, so that a difficulty may occur in a succeeding process. It is further likely that the chuck is not removed from the bag mouth after folding the bag mouth.

To solve this problem, JP-A 2-19223 suggests a construction in which a rotational shaft of the chuck is so eccentric that the rotational shaft lies on a folding line of the continuous sheet material, and the rotational shaft is moved each time that the chuck makes half a rotation. However it is extremely difficult to rotate and move the chuck at the same time. Also it requires a complicated mechanism.

JP-B 55-13976 (corresponding to JP-A 49-3937) discloses a method of attaching a tape to a package. A tape attacher roller is pressed to the article by moving along a line lying on an end face of the article, so as to attach the tape in the L-shape for enclosing the bag mouth firmly. This is an acceptable method if the article in the package is sufficiently rigid, for example a corrugated fiberboard box. However edges of the article are likely to be damaged by pressure of the tape attacher roller if the article in the package is fragile, and with the continuous sheet material being fragile.

In the apparatus, a front end of the tape is captured by the chuck. The tape is supplied by a regular length, is cut and then is attached to the article. It is necessary to retain a rear end of the tape by means of the suction on the side of a roll of the unused tape. A target portion to be captured by the chuck should be previously free. The tape with small rigidity in a general manner, however, has instability in the position of the front end after the cutting operation. Failure is likely to occur in capturing of the chuck.

JP-A 3-176344 suggests a method of retaining the front end of the tape by use of the suction. However it is extremely difficult to determine the sucking force greater than adhesive force of the tape. The tape cannot be run stably.

SUMMARY OF THE INVENTION

In view of the foregoing problems, an object of the present invention is to provide a pillow type packaging apparatus having high suitability to changing the size of the continuous sheet material.

Another object of the present invention is to provide a pillow type packaging apparatus in which looseness is avoided in the packaging bag in association with a gap with a tube forming guide unit.

A further object of the present invention is to provide a pillow type packaging apparatus in which gusset forming can be effected with high tightness without wrinkles.

Another object of the present invention is to provide a pillow type packaging apparatus in which gusset portions and a bag mouth can be bent or folded with agreeable appearance.

An additional object of the present invention is to provide a pillow type packaging apparatus in which tension can be kept suitably applied to the continuous sheet material during the folding operation of the bag mouth.

Another object of the present invention is to provide a pillow type packaging apparatus in which no excessive spaces in conveying directions for shifting stroke are required for a package conveyor in preventing interference with a bottom sealer.

Still another object of the present invention is to provide a pillow type packaging apparatus in which edges of the article can be prevented from damage even with pressure of a tape attacher.

Another object of the present invention is to provide a pillow type packaging apparatus in which a target portion of an adhesive tape can be captured reliably.

In order to achieve the above and other objects and advantages of this invention, a pillow type packaging apparatus includes a conveyor mechanism for conveying flexible continuous sheet material. A guide unit guides the continuous sheet material being conveyed, to form the continuous sheet material into a quadrangular tube in which a pair of longitudinal edges of the continuous sheet material are confronted with each other. A center sealer thermally seals up the longitudinal edges. An inserter inserts the article into the quadrangular tube through the guide unit while a front end of the article is directed downstream, the quadrangular tube being formed into the packaging bag by cutting and sealing. The guide unit includes an outer guide frame, and an inner guide frame disposed inside the outer guide frame. The outer guide frame includes first to fourth corner portions, disposed in a substantially quadrangular shape, having inside edges in contact with the continuous sheet material, for shaping the continuous sheet material into the quadrangular tube, the first to fourth corner portions being movable in directions of width and height of the continuous sheet material, to allow the quadrangular tube to change in a size. The inner guide frame includes fifth to eighth corner portions, associated respectively with the first to fourth corner portions, disposed in a substantially quadrangular shape, for contacting the continuous sheet material, to maintain the continuous sheet material shaped in the quadrangular tube along the inside edges of the first to fourth corner portions, the fifth to eighth corner portions being movable in the directions of the width and height of the continuous sheet material with respective distances therefrom to the first to fourth corner portions kept unchanged.

In a preferred embodiment, a cutter cuts the quadrangular tube containing the article to obtain the packaging bag, the packaging bag having a mouth formed by cutting of the cutter and an advancing bottom disposed opposite to the mouth. A bottom sealer is disposed upstream from the cutter, for sealing the advancing bottom. A mouth closing unit closes the mouth.

Consequently the inner guide frame is changeable in size not only in the width direction of the packaging bag but also in the vertical direction. In changing the size, the tube forming state can be adjusted while the continuous sheet material is manually supplied. The suitability to changing the size of the continuous sheet material is remarkably high. When the size of the packaging bag is required to change, the guide unit need not be entirely exchanged or deformed.

A controller sets a stroke of the inserter in accordance with a position determined inside the tube for inserting the article.

Consequently, tightness in the bottom sealed portion is kept high, as no wrinkles are caused in the gusset forming. No failure occurs in the gusset forming such as deviations between a folded line of gussets and any of four lateral edges of the packaging bag.

The inner guide frame is longer than the outer guide frame in a direction of conveying the continuous sheet material, and the inner guide frame includes a first frame portion surrounded by the outer guide frame. A second frame portion is formed to extend downstream from the first frame portion, the second frame portion having a contour larger than a contour of the first frame portion, and substantially equal to a contour of the outer guide frame.

Consequently, looseness does not occur in the packaging bag in association with a gap between the outer guide frame and the inner guide frame.

First and second bender plates respectively have a triangular shape, are disposed downstream from the guide unit, are confronted with first and second lateral faces of the quadrangular tube, the first and second lateral faces being opposite to one another, the first and second bender plates being swingable about respective axes thereof, for folding the first and second lateral faces inwards, the inserter positioning a rear end face of the article at the axes, the rear end face being opposite to the front end of the article. Third and fourth bender plates are disposed downstream from the guide unit, confronted with third and fourth lateral faces of the quadrangular tube, the third and fourth lateral faces being opposite to one another, the third and fourth bender plates being swingable, for folding the third and fourth lateral faces toward one another.

Consequently the bender plates make it possible to form gusseted portions with agreeable appearance. With the bender plates of the present invention distinct from the known bender members, the continuous sheet material can be prevented from being damaged.

First and second bender plates respectively have a triangular shape, are disposed downstream from the guide unit, confronted with first and second lateral faces of the quadrangular tube, the first and second lateral faces being opposite to one another, the first and second bender plates being swingable about respective axes thereof, the axes being disposed in a downstream end of the inner guide frame, the first and second bender plates folding the first and second lateral faces inwards. Third and fourth bender plates are disposed downstream from the guide unit, confronted with third and fourth lateral faces of the quadrangular tube, the third and fourth lateral faces being opposite to one another, the third and fourth bender plates being swingable, for folding the third and fourth lateral faces toward one another.

Again the bender plates make it possible to form gusseted portions with agreeable appearance. The continuous sheet material can be prevented from being damaged.

Furthermore, a pair of bag closing plates are disposed downstream from the cutter, driven before the cutter operates, for squeezing the quadrangular tube while the cutter operates.

Consequently with the present invention, tension can be kept suitably applied to the continuous sheet material during the folding operation of the bag mouth. Even when the article is fragile with small rigidity or has an edge liable to be damaged, the bag mouth can be folded tightly.

A folder chuck unit is disposed downstream from the cutter, and rotatable, for squeezing the mouth lying upstream from the bag closing plates, the bag closing plates being moved away from the packaging bag while the folder chuck unit squeezes the mouth. A rotating mechanism rotates the folder chuck unit, the folder chuck unit folding the mouth for one time or more while moved toward the article contained in the packaging bag.

Again, tension can be kept suitably applied to the continuous sheet material during the folding operation of the bag mouth. Even when the article is fragile with small rigidity or has an edge liable to be damaged, the bag mouth can be folded tightly.

A second conveyor mechanism is disposed downstream from the first conveyor mechanism, for conveying the packaging bag containing the article toward the folder chuck unit. A third conveyor mechanism is disposed downstream from the second conveyor mechanism, for conveying the packaging bag containing the article to an exit path. A slider slides the second conveyor mechanism between upstream and downstream positions with reference to a direction of conveyance, the second conveyor mechanism, when located in the upstream position, being away from the third conveyor mechanism, and when located in the downstream position, being away from the first conveyor mechanism, wherein the cutter, when the second conveyor mechanism is in the downstream position, cuts the quadrangular tube between the first and second conveyor mechanism, the bottom sealer, when the second conveyor mechanism is in the downstream position, seals the quadrangular tube, wherein the first conveyor mechanism, when the second conveyor mechanism is in the upstream position, conveys the continuous sheet material for next packaging bag to be produced. An extensible auxiliary path mechanism is connected to the second conveyor mechanism, extended when the second conveyor mechanism is moved to the upstream position, for providing a length additional to the second conveyor mechanism, to prevent the packaging bag with the article from dropping down from between the second and third conveyor mechanisms.

Consequently no excessive spaces in forward and reverse directions for shifting stroke are required for the conveyor in preventing interference with the bottom sealer by shifting the conveyor. Reception and delivery of the articles are effected at the same time, so that cycle time can be short and consistent to heightening efficiency.

A tape attacher attaches an adhesive tape to the packaging bag, the adhesive tape being secured to the mouth being folded, and on the end portion of the packaging bag and on an adjacent face of the packaging bag adjacent to the end portion of the packaging bag. The tape attacher further includes a push roller, disposed downstream from the bag closing plates, rotatable, and movable along a line on the end portion of the packaging bag, for pressing the adhesive tape against the end portion of the packaging bag. A tape retainer retains a portion of the adhesive tape on the adjacent face of the packaging bag, the tape retainer being protruded from the end portion partially, for preventing the push roller from pushing an edge between the end portion of the packaging bag and the adjacent face thereof, to protect the edge from being damaged.

Consequently edges of the article are safe and not damaged by pressure of the tape attacher if the article in the package is fragile, and with the continuous sheet material being fragile.

The tape attacher further includes a tape roll from which the adhesive tape is unwound. A feed chuck unit captures a distil end of the adhesive tape when located in a first position, the feed chuck unit being moved to a second position. An end chuck unit captures a portion of the adhesive tape near to the distal end when the feed chuck unit is located in the second position, the feed chuck unit, when the end chuck unit captures the portion, being released from capturing the distal end, and moved back to the first position. A tape cutter is disposed close to the first position, for cutting the adhesive tape after the end chuck unit captures the portion.

Consequently the target portion of the tape can be captured reliably by the chuck even if the tape has small rigidity. There is no instability in the position of the front end after the cutting operation.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1B:
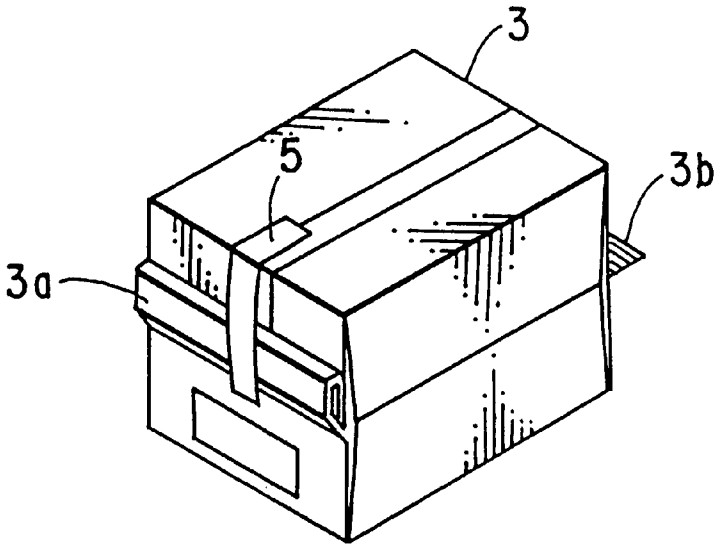
FIG. 1B is a rear perspective illustrating the article with the packaging bag wrapping the article.
Figure 1A:
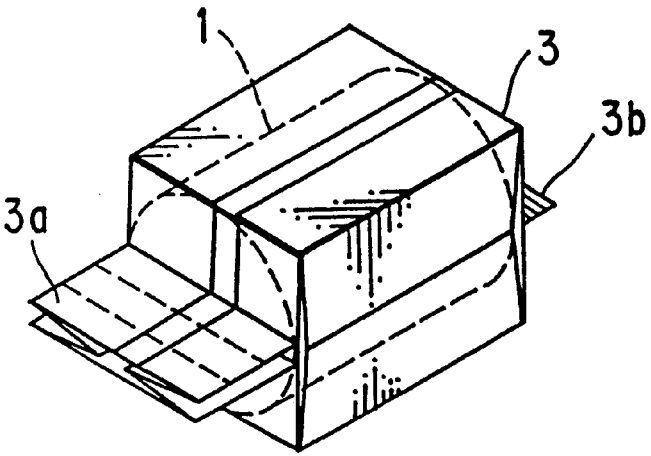
FIG. 1A is a front perspective illustrating an article with a packaging bag wrapping an article.

In FIGS. 1A and 1B, a package is depicted, in which an article 1 is packaged. The article 1 is, for example, a roll of photosensitive material, such as photographic paper. A gusseted bag or packaging bag 3 is used to package the article 1, and is produced from continuous sheet material 2 or flat continuous material. See FIG. 2. The continuous sheet material 2 consists of, for example, continuous kraft paper with lamination of polyethylene colored black. The packaging bag 3 has a rear closing portion or bag mouth 3*a*, which is folded three times and tightly closed with an adhesive tape 5. The packaging bag 3 has an advancing bottom 3*b*, which is tightly closed by thermal welding by a bottom sealer 6 as front end closing unit (See FIG. 2). Note that the terms of the "bottom" 3*b* and the "bottom sealer" 6 are commonly used in the field of packaging techniques. In any part of the present description, the "bottom" 3*b* and the "bottom sealer" 6 relates to an advancing face of the packaging bag 3, and not to a lower face of the packaging bag.

Figure 2:
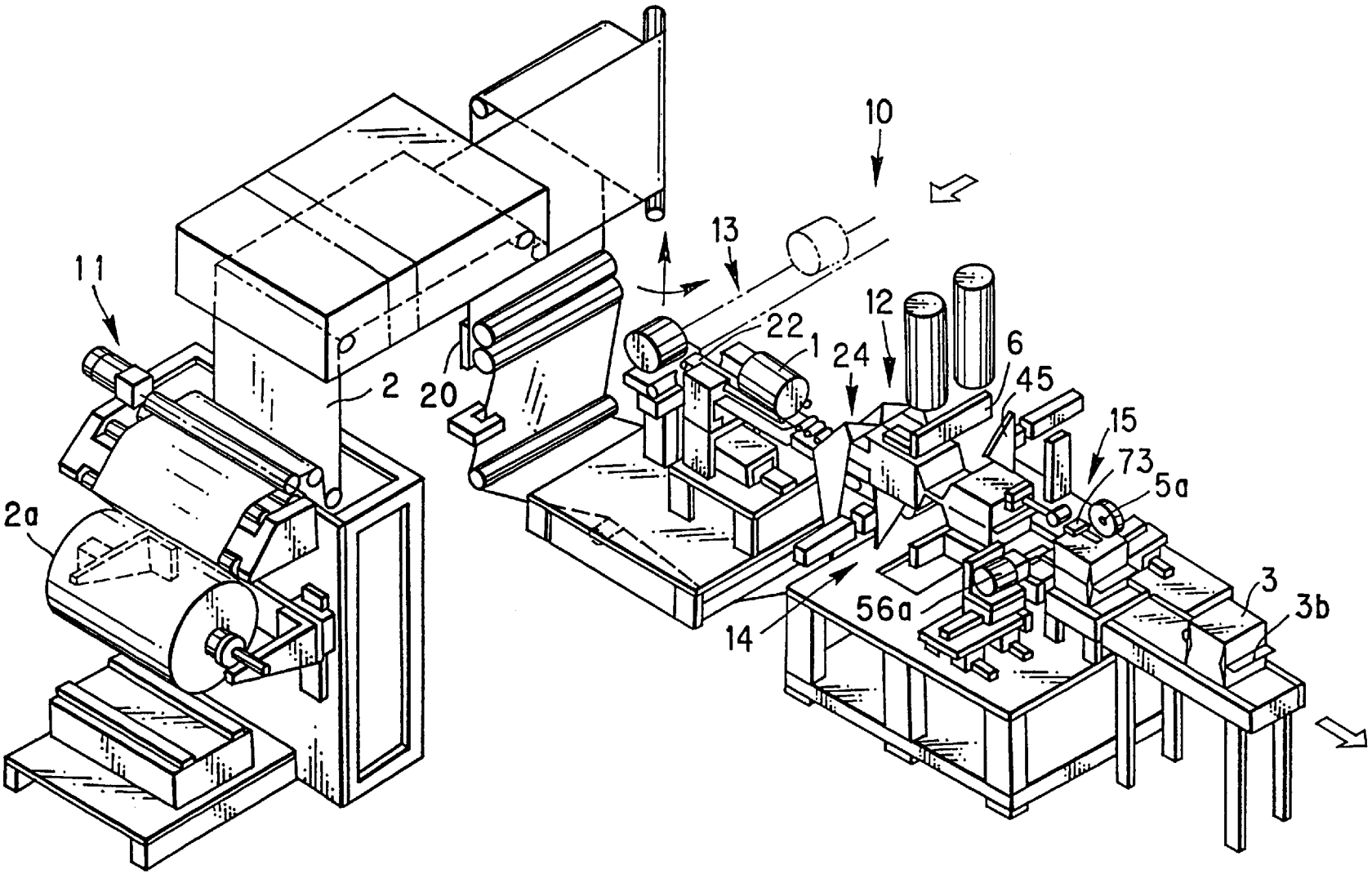
FIG. 2 is a perspective illustrating a packaging apparatus.

In FIG. 2, a packaging apparatus 10 comprises a material supplier 11, a tube former 12, an article supplier 13, an inserter 22, a bender/sealer 14 and a folder/attacher 15. The bender/sealer 14 and the folder/attacher 15 comprise a rear end closing unit. In the material supplier 11 is a packaging material roll 2*a* in which the continuous sheet material 2 is wound. The material supplier 11 supplies the tube former 12 with the continuous sheet material 2. The tube former 12 forms the continuous sheet material 2 into a tube having a quadrangular shape as viewed in cross section, and welds together lateral edges of the continuous sheet material 2 by heat sealing along the center of the tube. The article supplier 13 inserts the article 1 at a regular interval into a downstream tubular portion of the continuous sheet material 2 past the tube former 12.

The bender/sealer 14 bends lateral faces of the quadrangular tubular shape of the continuous sheet material 2 in inward directions, and discharges air from between consecutively provided two articles. Then the bender/sealer 14 thermally welds the continuous sheet material 2 in its width direction, and cuts the continuous sheet material 2 by use of a cutter. The folder/attacher 15 folds the bag mouth 3*a* of the packaging bag 3 three times, and attaches the adhesive tape 5 to it for keeping the bag mouth 3*a* folded. Note that the adhesive tape 5 is supplied from a tape roll 5*a* in which the adhesive tape 5 is wound in a roll form.

In the present apparatus, an operation of supply of the article and tube forming is effected in an intermittent manner. While the tube forming is stopped, the bender/sealer 14 is operated. After cutting of the continuous sheet material 2 in the width direction with the cutter, the article being packaged is conveyed to the folder/attacher 15. At the same time as this, the tube forming is started. The above process is repeated.

Figure 3:
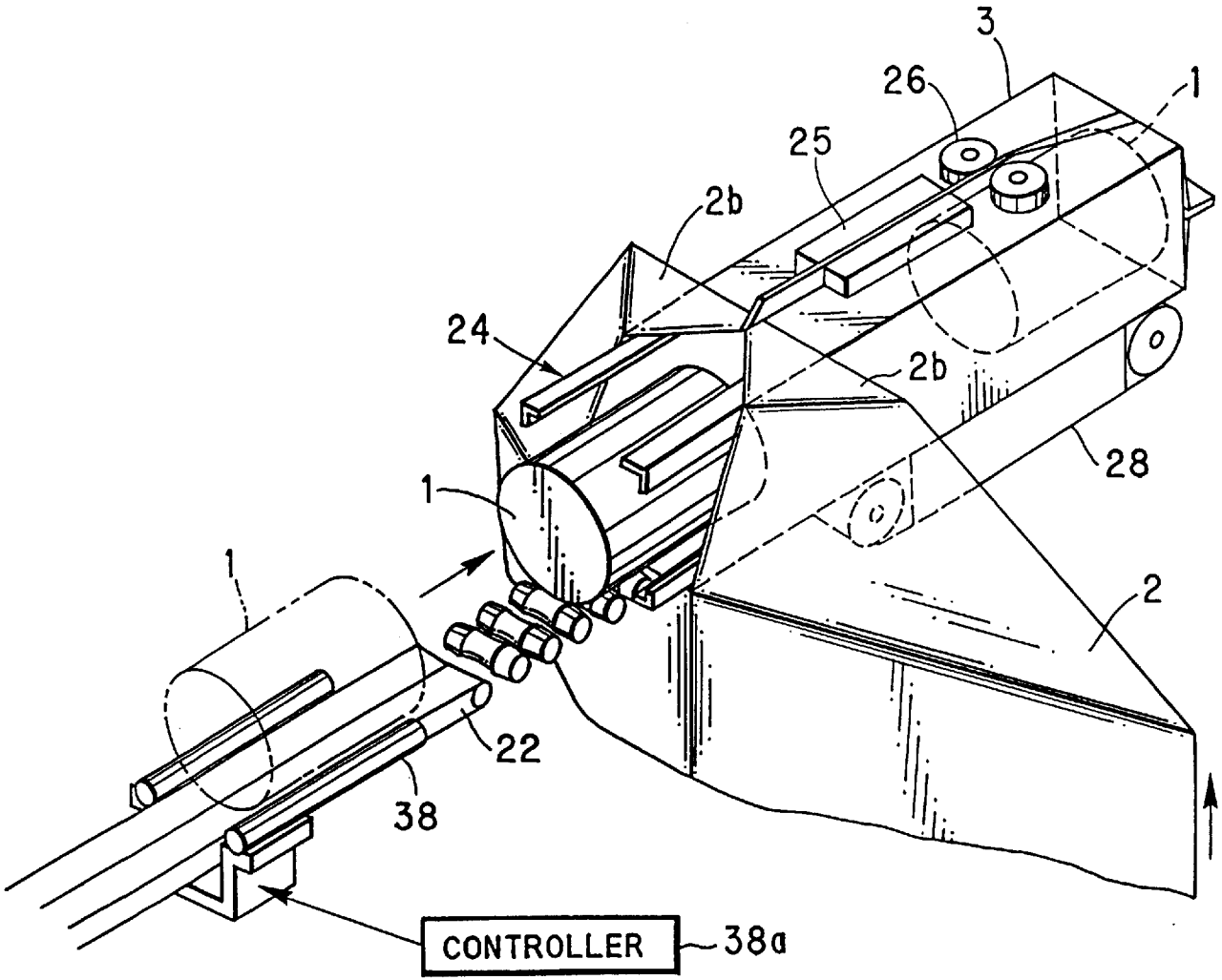
FIG. 3 is a perspective illustrating an article supplier and a suction belt cooperating for tube forming and insertion of the article.

Components of the systems are described hereinafter in a downstream order. The continuous sheet material 2 from the material supplier 11 is passed through an edge position controller 20 (referred to as E.P.C.) for rectifying an edge position of the continuous sheet material 2, and then moved under an article conveyor 22 as inserter. Then the continuous sheet material 2 is introduced to a guide unit 24 in the tube former 12 adapted to forming the continuous sheet material 2 into the packaging bag 3. See FIG. 4. The continuous sheet material 2 is shaped by the guide unit 24 into a tubular form having a quadrangular shape as viewed in cross section. In FIG. 3, lateral edges 2*b* of the continuous sheet material 2 are moved for conveyance by the virtue of feed rollers 26 and a suction belt 28. The feed rollers 26 and the suction belt 28 cooperate as a conveyor mechanism. The feed rollers 26 are disposed in a position immediately past a center sealer 25. The suction belt 28 is disposed as a base surface of a conveying path for the article 1.

To be precise, force applied in the downstream direction to the continuous sheet material 2 is determined by combination of the feed rollers 26 and the suction belt 28. A component force applied by the suction belt 28 to the continuous sheet material 2 is determined equal to or greater than resistant force applied to the continuous sheet material 2 by the guide unit 24 against the conveyance of the continuous sheet material 2.

Figure 4:
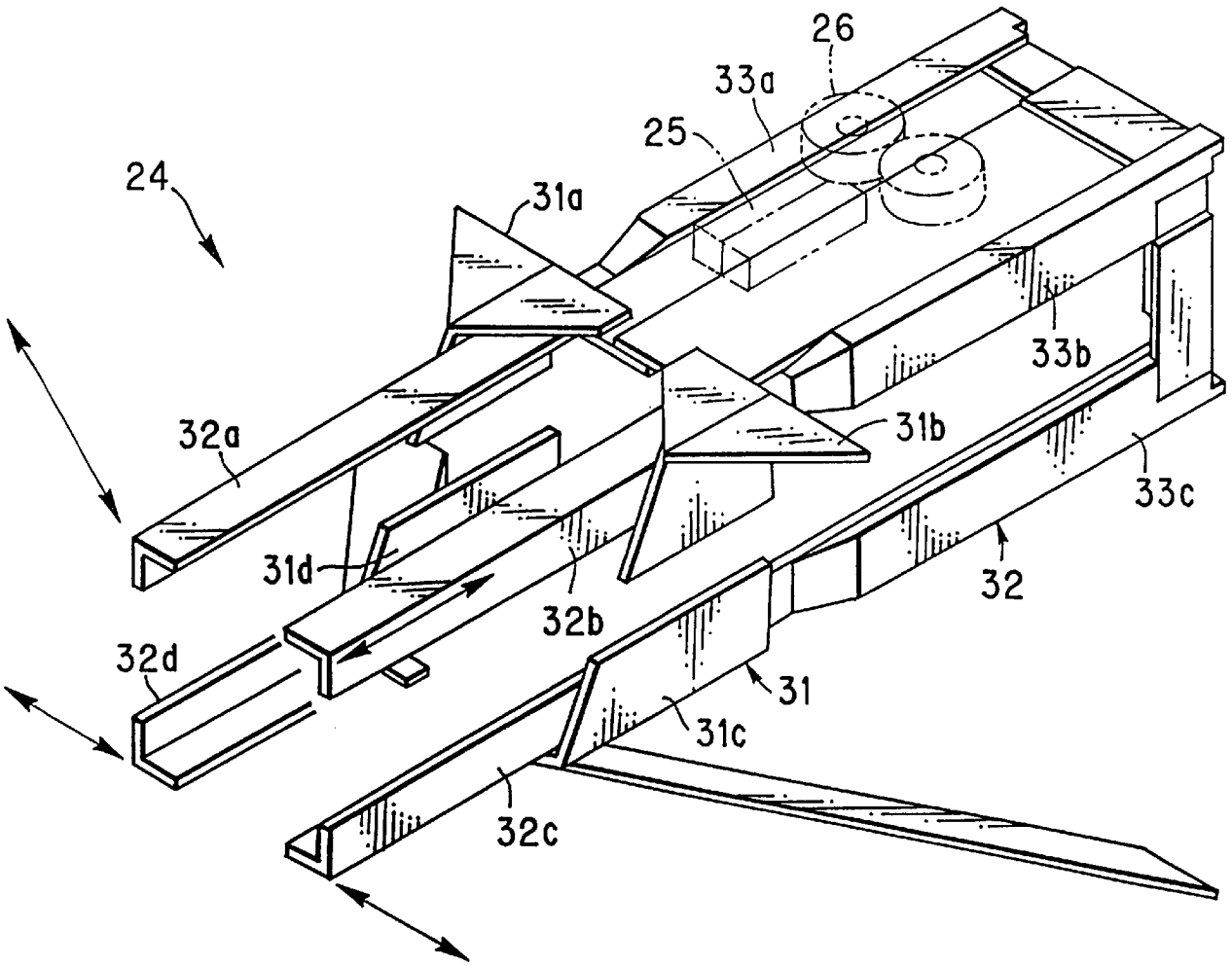
FIG. 4 is a perspective illustrating a tube forming guide unit.
Figure 5A:
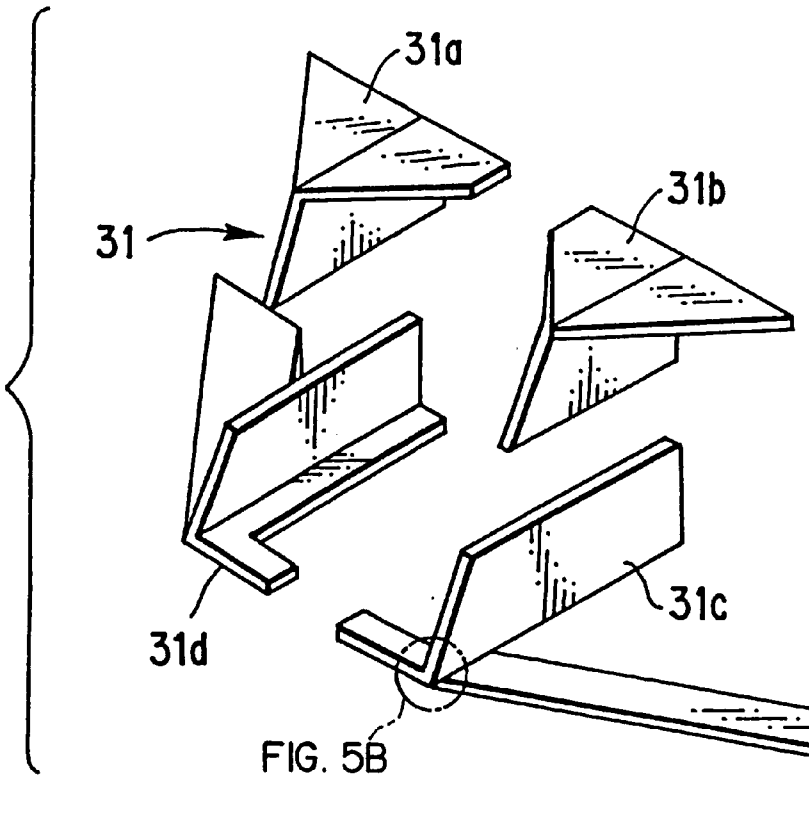
FIGS. 5A and 5B is a perspective views illustrating an outer guide frame.

In FIG. 4, the guide unit 24 is constituted by an outer guide frame 31 and an inner guide frame 32. The outer guide frame 31 regulates a surface to become the outside of the packaging bag 3. The inner guide frame 32 regulates a surface to become the inside of the packaging bag 3. In FIG. 5A, the outer guide frame 31 includes four corner portions 31*a*, 31*b*, 31*c* and 31*d* separate from one another. Each of the corner portions 31*a*–31*d* forms a lateral edge of the packaging bag 3. For enabling an operation of forming the packaging bag 3 in any of various sizes, the position of each of the corner portions 31*a*–31*d* is changeable by use of an AC servo motor, which is connected to it by a ball screw.

Figure 6:
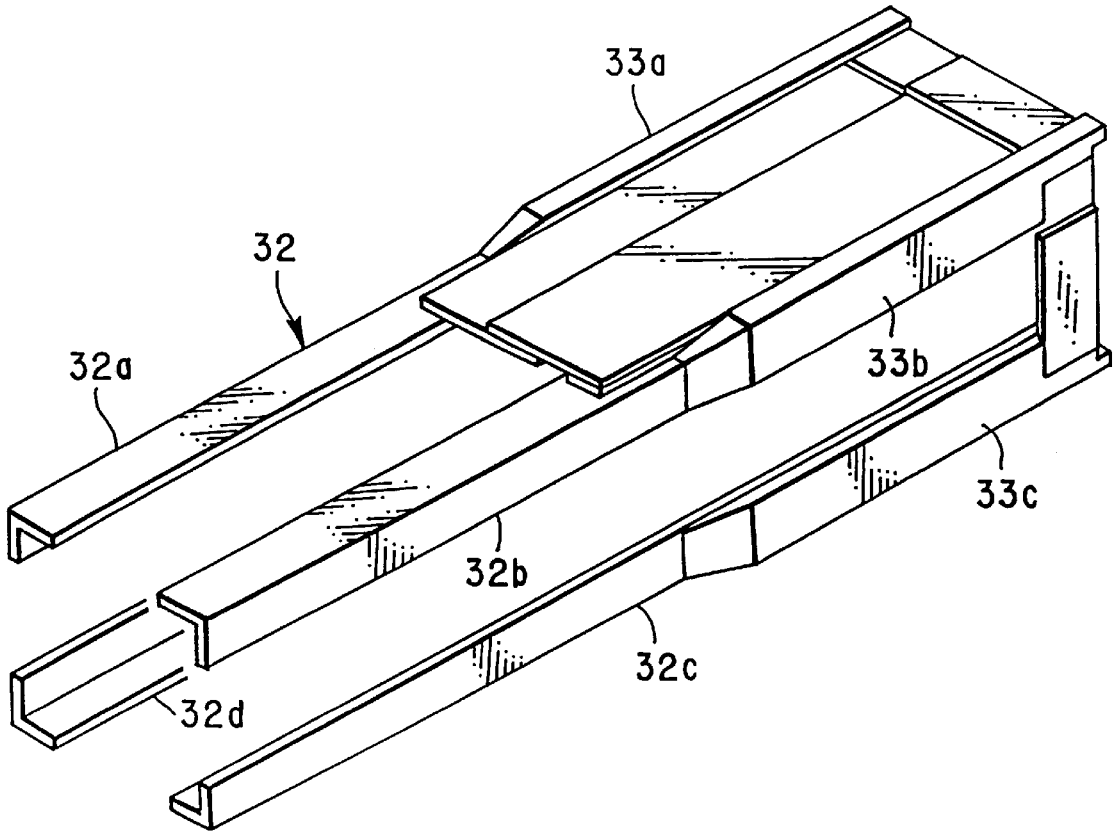
FIG. 6 is a perspective illustrating an inner guide frame.

In FIG. 6, the inner guide frame 32 includes four rails 32*a*, 32*b*, 32*c* and 32*d* as a first frame portion. Each of the rails 32*a*, 32*b*, 32*c* and 32*d* has an L-shape as viewed in cross section, and supports an inside of one respective lateral edge of the packaging bag 3. The rail 32*a* is kept with a predetermined clearance from the corner portion 31*a*, and disposed in a shiftable manner together with the corner portion 31*a*. The position of the rail 32*a* is changeable by use of an AC servo motor, which is connected to it by a ball screw. Similarly the rails 32*b*, 32*c* and 32*d* are respectively associated with the corner portions 31*b*, 31*c* and 31*d*.

If the width of the continuous sheet material 2 is required to change, the feed rollers 26 are released from the nipping state. The center sealer 25 and the feed rollers 26 are moved upwards and retreat. The continuous sheet material 2 is conveyed only by the suction belt 28. The outer guide frame 31 and the inner guide frame 32 are moved in synchronism to positions associated with a new designated size. An attached portion between a new continuous sheet material and the older continuous sheet material 2 is discharged. Afterwards the center sealer 25 and the feed rollers 26 are set in positions for the new size, and lowered and set in the nipping state. The size is thus changed over. The apparatus stands by for insertion of article having the new size.

Figure 5B:
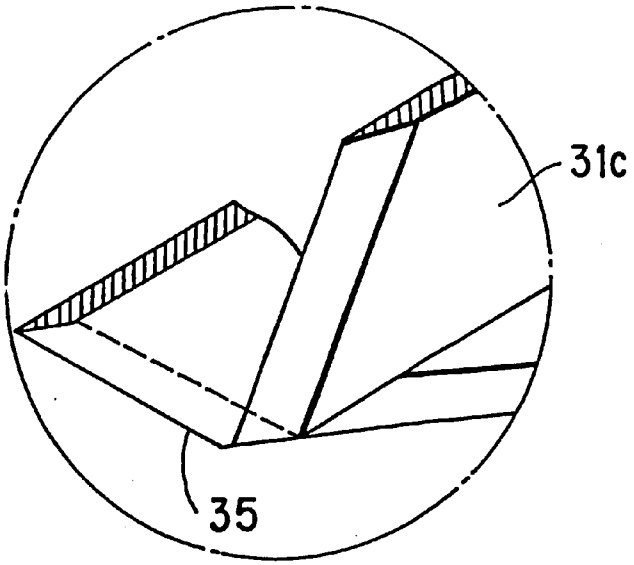

In FIGS. 5A and 5B, front edges 35 of the corner portions 31*a*–31*d* of the outer guide frame 31 are tapered, and remain to have flatness with inner surfaces of the corner portions 31*a*–31*d*. A radius of curvature R of the front edges 35 is in a preferable range of 0.2–0.3 mm, and is nearly equal to a thickness T of the continuous sheet material 2. This is effective in reducing resistance of the guide unit 24 against conveyance of the continuous sheet material 2. Note that, for reducing resistance of the guide unit 24, it is also possible to attach a teflon member to the front edges 35, coat the front edges 35 with teflon, or finish the front edges 35 with a mat finished surface. Of course, the teflon may be replaced with other material with low coefficient of friction.

It is to be noted that the outer guide frame 31 may be formed to satisfy a condition of:

$$T \leqq R \leqq 5 \text{ mm.}$$

The rails 32*a*–32*d* of the inner guide frame 32 are determined longer than the corner portions 31*a*–31*d* in the conveying direction of the article 1. The inner guide frame 32 includes rails 33*a*, 33*b* and 33*c* and a rail 33*d* (not shown) as a second frame portion. The rails 33*a*–33*d* have a thickness enlarged in an outward direction to such an extent that the rails 33*a*–33*d* have a contour substantially equal to an inside of the outer guide frame 31, namely the outside of the tube.

In FIG. 3, a robot arm 38 as inserter in the article supplier 22 is controlled by a controller 38*a*, and operated to insert the article 1 at a predetermined interval into the packaging bag 3 past the guide unit 24. In the present embodiment, two articles 1 are inserted into the packaging bag 3 by the robot arm or inserter 38. Alternatively it is possible to insert a single article into the packaging bag 3 in a deepest position of the guide unit 24, specifically with sufficiency in cycle time, and rigidity and stroke of the robot arm or inserter 38. Even when the size of the article 1 is changed, operation of changing the interval of the articles can be eliminated.

Figure 7A:
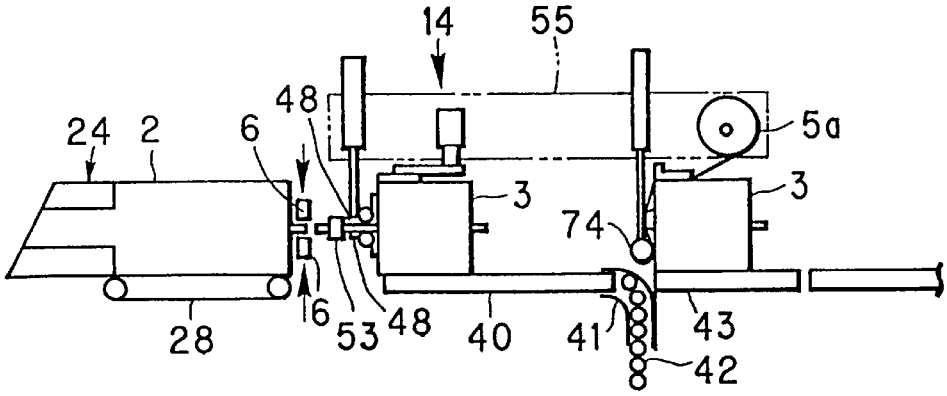
FIG. 7A is an explanatory view in elevation, illustrating a state of sealing and cutting the front end of the packaging bag.
Figure 7B:
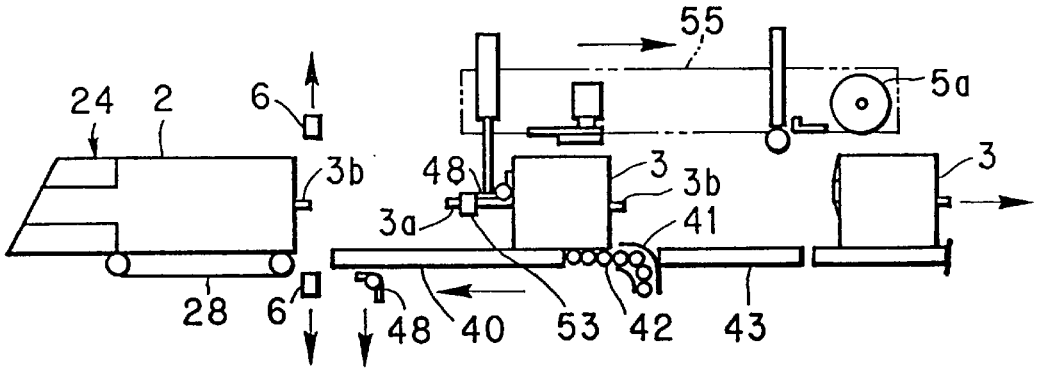
FIG. 7B is an explanatory view in elevation, illustrating a state of conveying the packaging bag after the cutting operation.
Figure 7C:
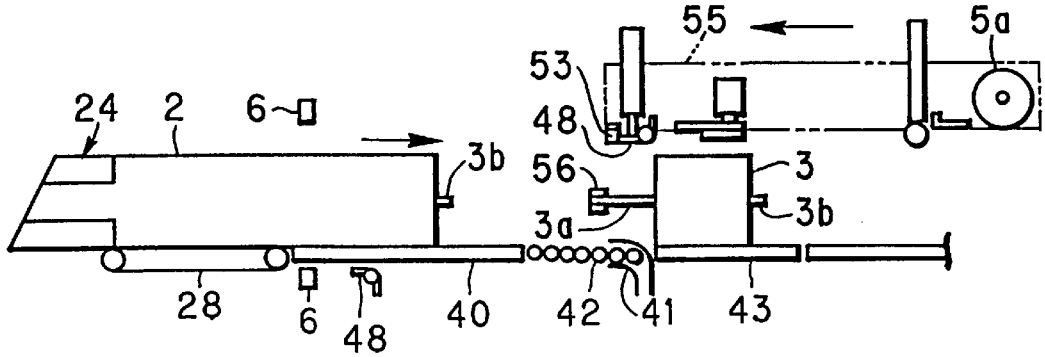
FIG. 7C is an explanatory view in elevation, illustrating a state of squeezing the bag mouth after conveying the packaging bag.
Figure 7D:
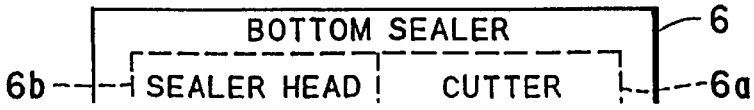
FIG. 7D is a schematic view illustrating a sealer head and a cutter.

Each article 1, after being packaged by the tube former 12, is conveyed to the bender/sealer 14. A shiftable feeder mechanism 40 in the bender/sealer 14 for receiving the packaging bag 3 with the article 1 contained has a moving construction of FIGS. 7A–7C for the purpose of avoiding interference between the bottom sealer 6 and the benders for forming the gussets. In FIG. 7D, the bottom sealer 6 includes a cutter 6*a*, and a sealer head 6*b*.

Figure 7E:
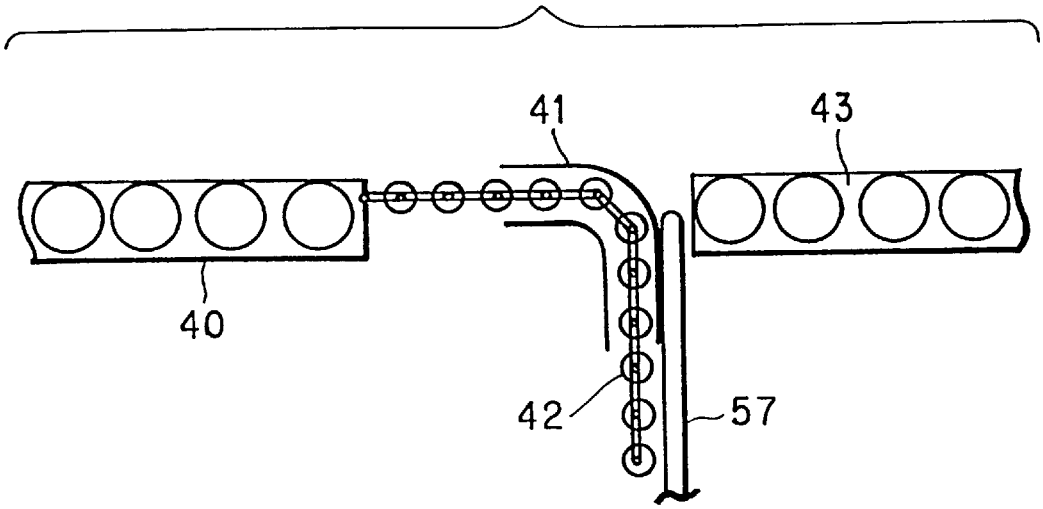
FIG. 7E is an explanatory view in elevation, illustrating a roller train in connection with a slidable conveyor.

In FIG. 7E, a roller train 42 as an extensible path mechanism is connected to a downstream end of the shiftable feeder mechanism 40. The roller train 42 is a train of plural rollers connected to one another. The roller train 42 is inserted in an L-shaped guide tube 41. When the shiftable feeder mechanism 40 is shifted toward the tube former 12 to receive the packaging bag 3, the roller train 42 absorbs occurrence of a gap between the shiftable feeder mechanism 40 and a conveyor 43 as a downstream conveyor path. The conveyor 43 is adapted for a succeeding process of folding the rear closing portion or bag mouth.

Figure 7F:
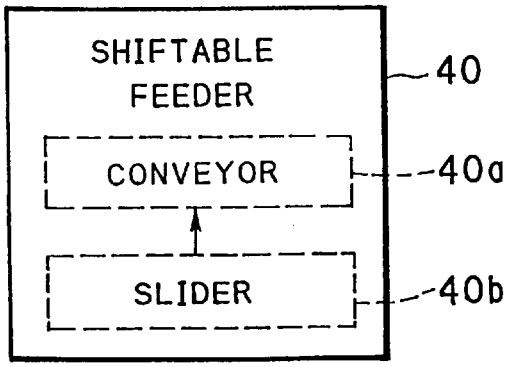
FIG. 7F is a schematic view illustrating a conveyor and a slider associated therewith.

In FIG. 7F, the shiftable feeder mechanism 40 includes a conveyor 40*a* and a slider 40*b*. The conveyor 40*a* includes plural rollers which are rotated in synchronism to feed the article 1 with the packaging bag 3 wrapping the article 1. Alternatively the conveyor 40*a* may consist of a conveyor belt. The slider 40*b* slides the conveyor 40*a* in downstream and upstream directions.

Figure 8B:
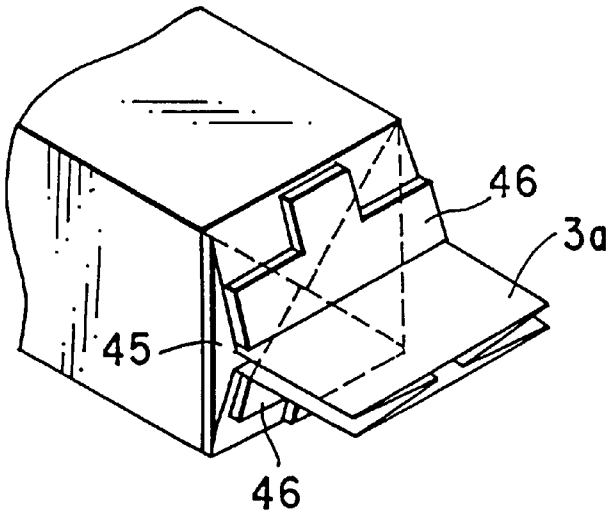
FIG. 8B is a perspective, partially cutaway, illustrating a bending state of the bender plates.
Figure 8A:
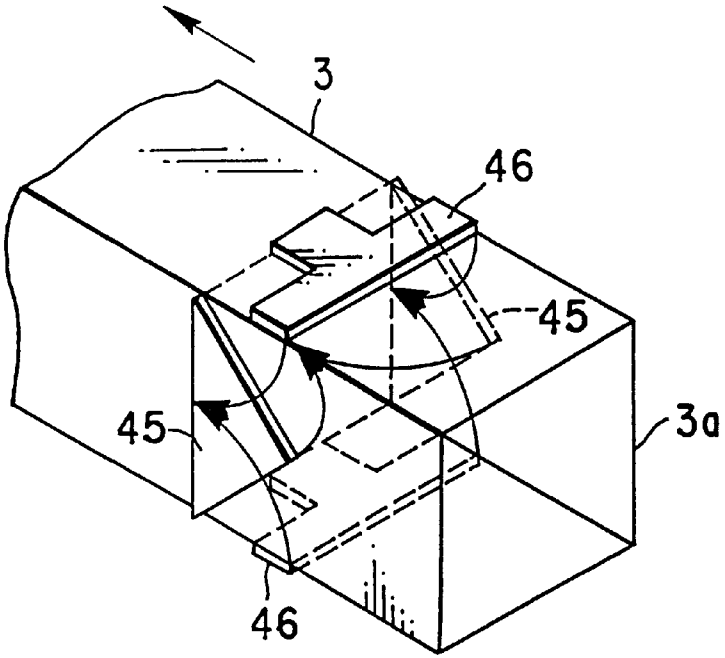
FIG. 8A is a perspective, partially cutaway, illustrating bender plates for bending a bag mouth.
Figure 9C:
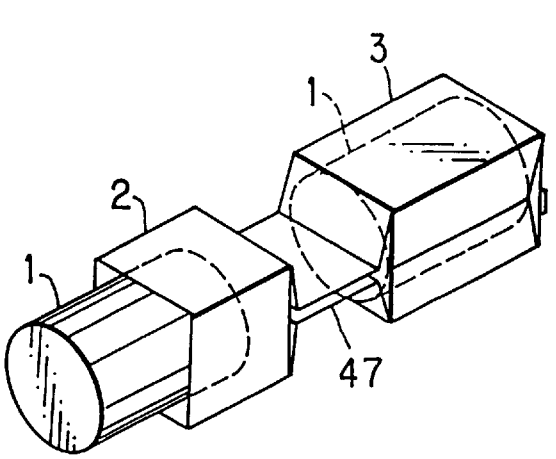
FIG. 9C is a perspective, partially cutaway, illustrating a state where the gussets are formed but not yet cut.
Figure 9B:
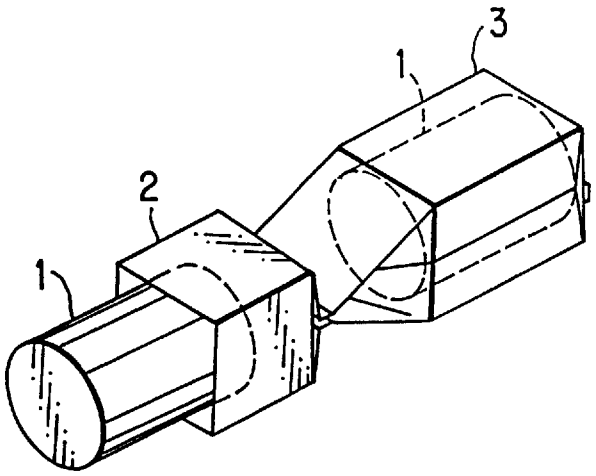
FIG. 9B is a perspective, partially cutaway, illustrating a state where gussets are being formed in the tube.
Figure 9A:
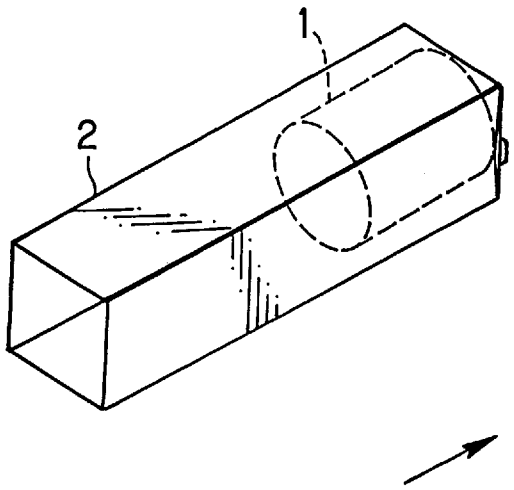
FIG. 9A is a perspective, partially cutaway, illustrating a quadrangular tube into which the article is inserted.

In FIGS. 8A and 8B, the bender/sealer 14 includes first and second bender plates 45 and third and fourth bender plates 46, all of which are located on the side of the guide unit 24 upstream from the bender/sealer 14. The bender plates 45 and 46 are swingable, and correspond to respective four sides of the quadrangle of the cross section of the tube. The first and second bender plates 45 have a triangular shape, and are swing to bend centers of two opposite lateral faces of the continuous sheet material 2 in an inward direction. The third and fourth bender plates 46 have a T-shape, and swing to bend top and bottom horizontal faces of the continuous sheet material 2 toward each other. In FIGS. 9A–9C, a folded tubular portion 47 is formed on the continuous sheet material 2 between the articles by the first and second bender plates 45.

Figure 10:
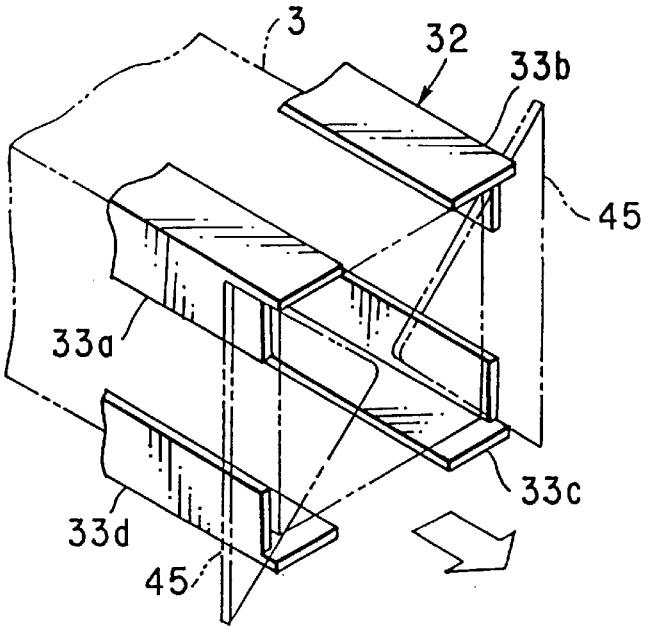
FIG. 10 is a perspective, partially cutaway, illustrating another preferred embodiment of bender plates.

Rotational axes of the first and second bender plates 45 are disposed at an end of the inner guide frame 32. The third and fourth bender plates 46 swing to cover the first and second bender plates 45 at least partially. It is preferable to dispose the rotational axes of the first and second bender plates 45 relatively closer to the guide unit 24 for the purpose of neatening the gussets. In FIG. 10, top and bottom portions of the inner guide frame 32 are relatively long in the downstream direction. This is effective in eliminating distortion of the packaging bag 3 due to the thickness of the first and second bender plates 45. Note that the T-shape of the third and fourth bender plates 46 is to prevent interference with the first and second bender plates 45.

Figure 11:
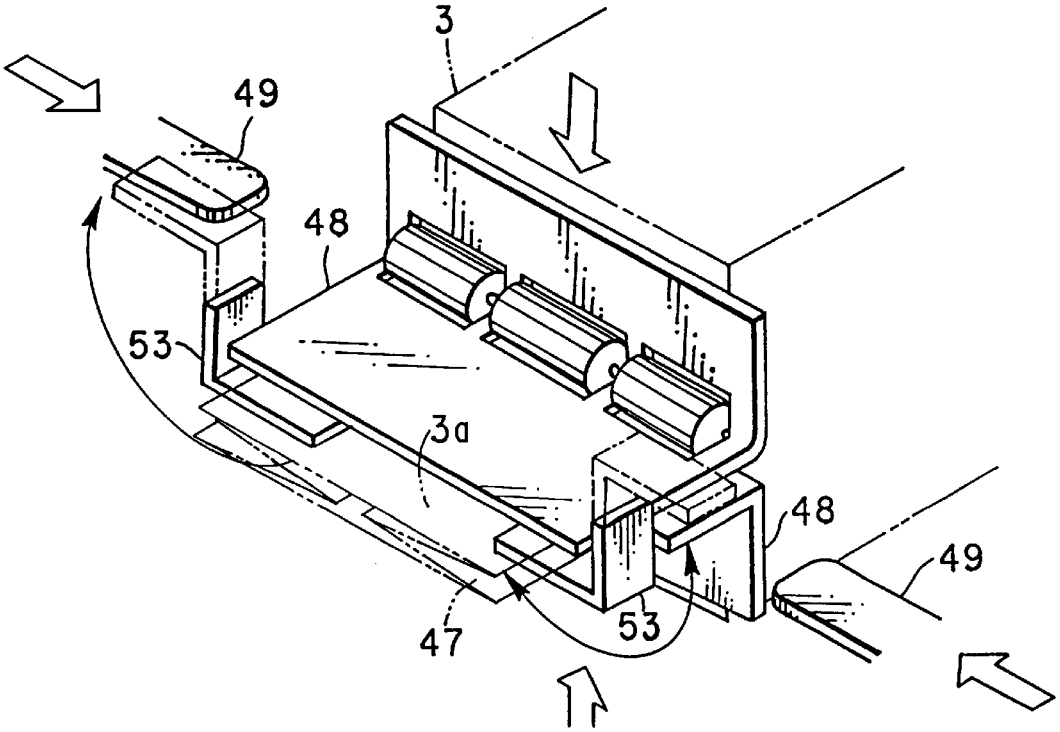
FIG. 11 is a perspective, partially cutaway, illustrating a state where the bag mouth is initially chucked.

In FIG. 11, there are arranged bag closing plates 48 and push guides 49 on the downstream side of the bender/sealer 14. The bag closing plates 48 squeeze the bag mouth 3*a* between them in the vertical direction. The push guides 49 push the folded tubular portion 47 of the bag mouth 3*a* in the inward direction. After the contact with the first and second bender plates 45, the third and fourth bender plates 46, the bag closing plates 48 and the push guides 49, the continuous sheet material 2 with the bag mouth 3*a* and the folded tubular portion 47 is welded together and closed by the bottom sealer 6, which is moved up and down by an air cylinder. Then the continuous sheet material 2 is cut by the cutter 6*a* located on the side of the bottom sealer 6.

Beside the bag closing plates 48 are disposed transfer chucks 53, which squeeze the bag mouth 3*a* between the transfer chucks 53 and an upper one of the bag closing plates 48 after folding the folded tubular portion 47. The transfer chucks 53 are rotatable. In FIG. 7A, the transfer chucks 53 squeeze the bag mouth 3*a* before the continuous sheet material 2 is cut. The transfer chucks 53 are arranged in a transfer unit 55 to allow the packaging bag 3 to be conveyed to the folder/attacher 15 in a squeezed state. See FIGS. 7A–7C.

Figure 12:
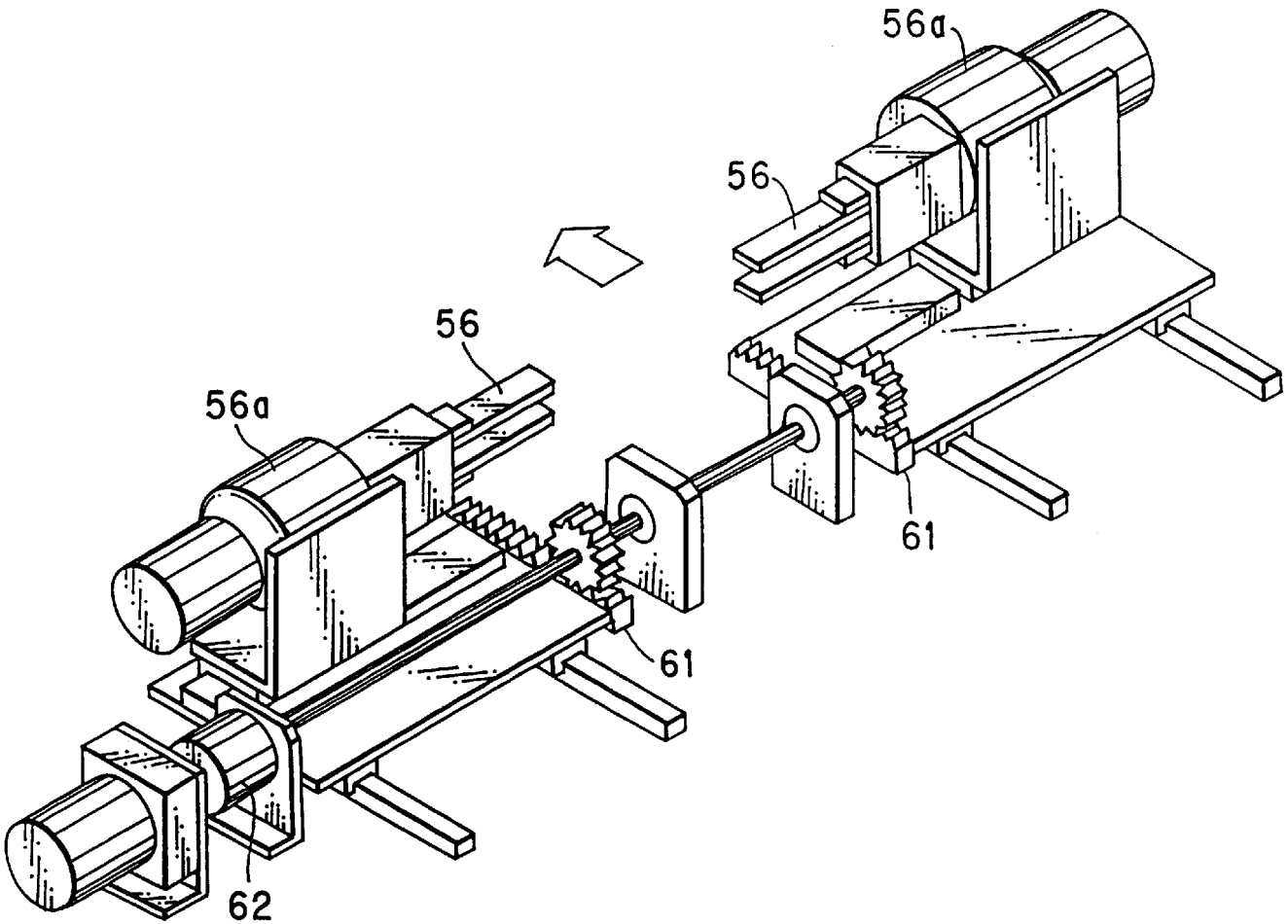
FIG. 12 is a perspective illustrating folder chucks and a brake unit connected thereto.

In FIG. 12, there are a pair of folder chucks 56 arranged in the folder/attacher 15 for squeezing the bag mouth 3*a*. The folder chucks 56, while rotated, are moved toward the packaging bag 3. The bag mouth 3*a* of the packaging bag 3, when the bag mouth 3*a* is positioned by the transfer chucks 53 and conveyed to the folder/attacher 15 as depicted in FIG. 7B, is squeezed by the folder chucks 56, and then released from the transfer chucks 53. See FIG. 7C.

Figure 13:
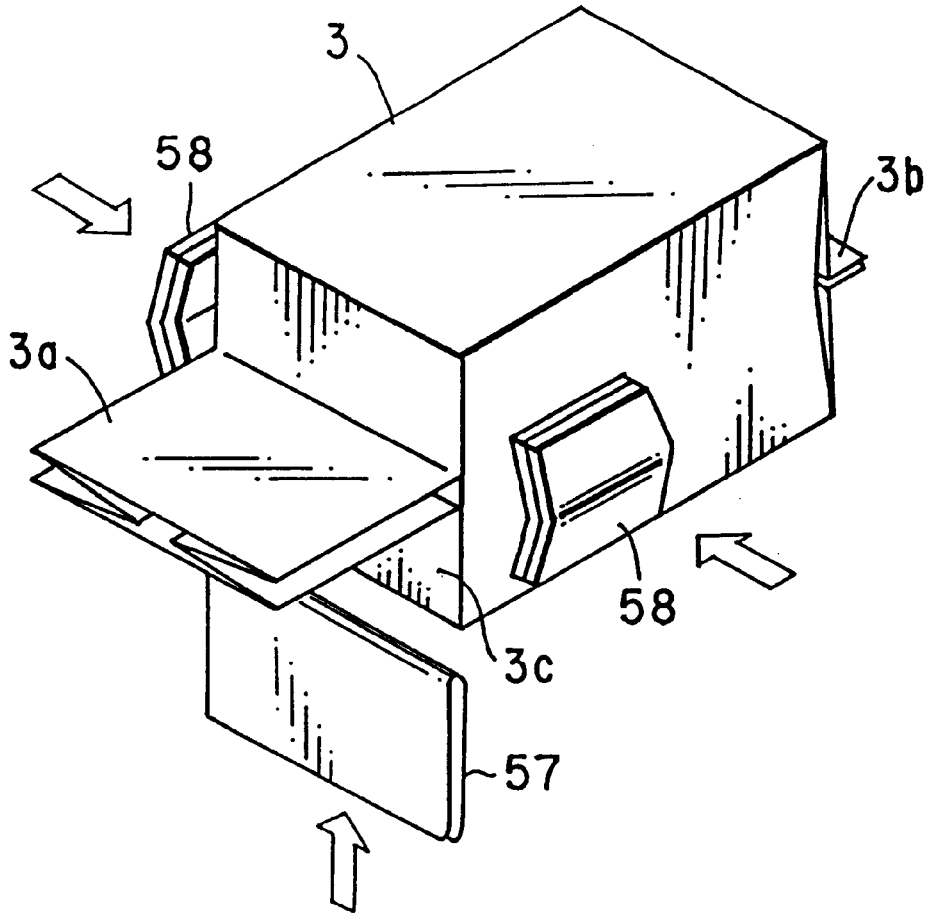
FIG. 13 is a perspective illustrating a state where air is discharged through the bag mouth by discharge plates.
Figures 14A, 14B, 14C, 14D:
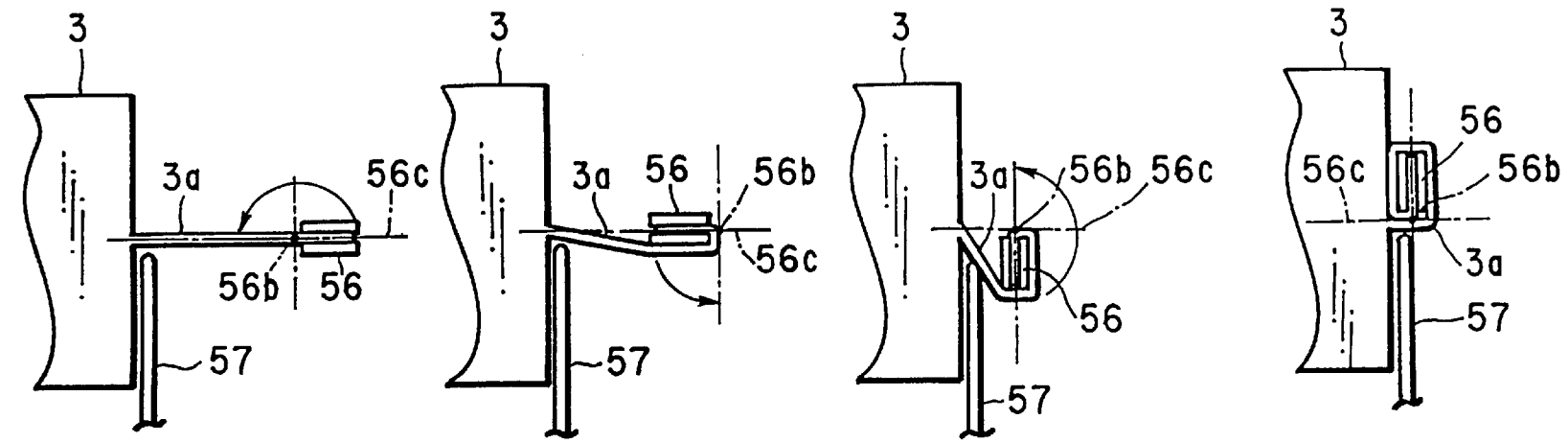
FIG. 14A is a side elevation, partially cutaway, illustrating a state where the folder chucks are initially oriented.
FIG. 14B is a side elevation, partially cutaway, illustrating a state where the folder chucks have made half a rotation.
FIG. 14C is a side elevation, partially cutaway, illustrating a state where the folder chucks have made three fourths of one rotation.
FIG. 14D is a side elevation, partially cutaway, illustrating a state where the folder chucks have finished the mouth folding after five fourths of one rotation.

In FIG. 13, an end face pressing member 57 is raised to push a rear end face 3*c* of the packaging bag 3. A pair of air discharge guides 58 push lateral faces of the packaging bag 3 to discharge air through an open end of the bag mouth 3*a*. In FIGS. 14A–14D, the folder chucks 56 squeezing the bag mouth 3*a* are caused by a rotating mechanism 56*a* to make (1+¼) rotations, so that the bag mouth 3*a* is folded three times. A reference numeral 56*b* designates a central shaft about which the folder chucks 56 are rotated.

In FIG. 12, a hysteresis brake unit 62 is located in a position downstream from the folder chucks 56, and is connected to each of the folder chucks 56 via a rack/pinion mechanism 61. The hysteresis brake unit 62 applies back tension to the folder chucks 56. Although the folder chucks 56 are rotatable in an eccentric manner, the hysteresis brake unit 62 causes the folder chucks 56 to effect a folding operation with sufficient tightness.

The central shaft 56*b*, about which the folder chucks 56 are rotatable, is also slid along a straight path or orbit 56*c* indicated by the phantom lines in FIGS. 14A–14D.

Figure 15:
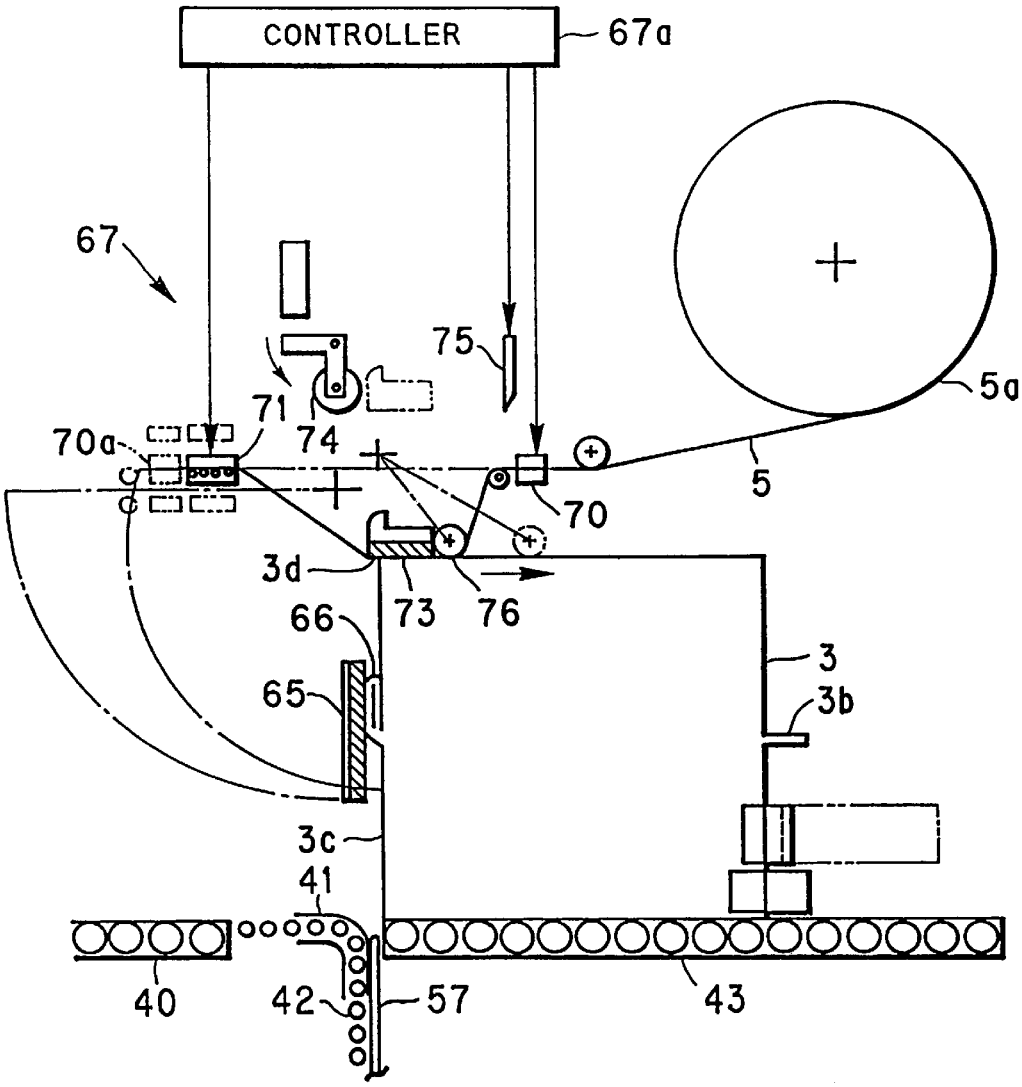
FIG. 15 is an explanatory view in side elevation, illustrating a tape attacher in the packaging apparatus.

After the folding operation, a retainer 65, in FIG. 15, retains a folded portion 66 in a folded state. Then the folder chucks 56 are pulled away. A tape attacher 67 attaches the adhesive tape 5 to the packaging bag 3 over the folded portion 66 in an L-shape. In the course of pulling the folder chucks 56, the sides of the packaging bag 3 are retained by the air discharge guides 58, so as to stabilize the position of the packaging bag 3.

Figure 16A:
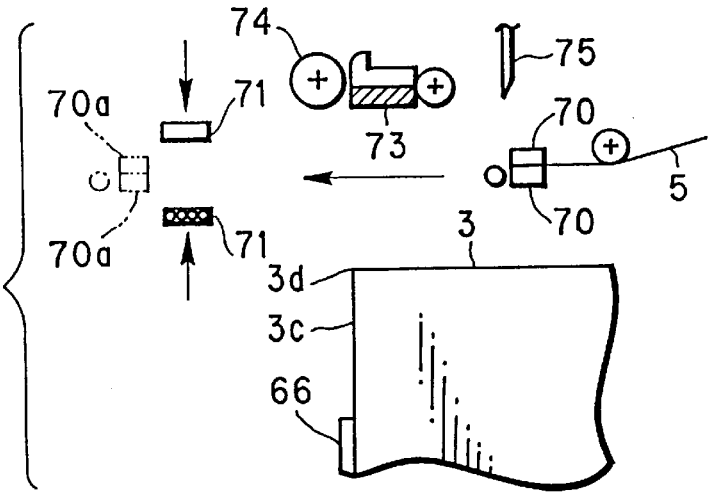
FIG. 16A is an explanatory view in side elevation, illustrating a state where a feed chuck initially captures a tape end.
Figure 16B:
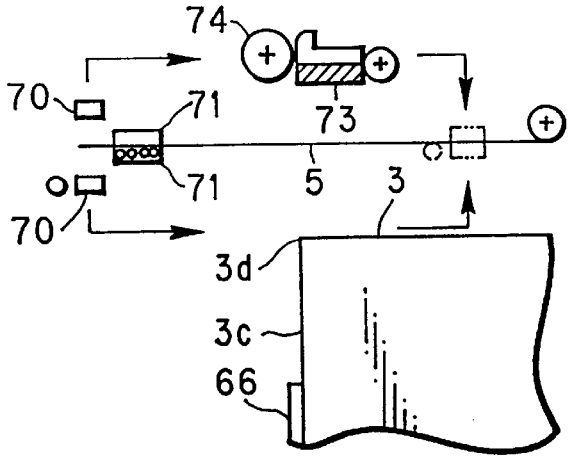
FIG. 16B is an explanatory view in side elevation, illustrating a state where the feed chuck has pulled the tape.
Figure 16C:
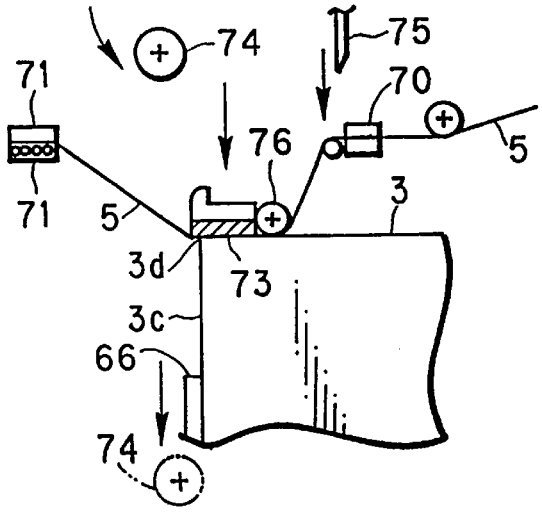
FIG. 16C is an explanatory view in side elevation, illustrating a tape retainer retains the tape in contact with the package.

In FIGS. 16A–16C, the adhesive tape 5 is unwound from the tape roll 5*a* by a feed chuck unit 70 and extended by a predetermined distance to a position 70*a* of FIG. 16A. The feed chuck unit 70 is controlled by a controller 67*a*. Then the leading end of the adhesive tape 5 is captured by an end chuck unit 71. See FIG. 16B. Then the feed chuck unit 70 is released from the capture, and moved back to its home position. Again the adhesive tape 5 is captured by the feed chuck unit 70. There is a tape retainer 73 which is movable toward and away from the packaging bag 3, and is disposed in such a manner that a rear end of the tape retainer 73 is projected beyond the level of the rear end face 3*c* of the packaging bag 3. After the state of FIG. 16B, the tape retainer 73 is moved down to the packaging bag 3. A push roller 74 or ironing roller is rotated while moved down along the rear end face 3*c*, to push the leading end of the adhesive tape 5 to the rear end face 3*c* for tight attachment, so that the folded portion 66 is enclosed by the adhesive tape 5. Since the end of the tape retainer 73 is protruded beyond the level of the rear end face 3*c*, the tape retainer 73 protects corners 3*d* of the packaging bag 3, and prevents the push roller 74 from breaking the corners 3*d* with pressure.

In the vicinity of the feed chuck unit 70, a tape cutter 75 is lowered to cut the adhesive tape 5 to which tension is being applied, as illustrated in FIG. 16C. A portion squeezed by the feed chuck unit 70 becomes a next formed leading end of the adhesive tape 5. Immediately a push roller 76 behind the tape retainer 73 starts rotating and moving away from the tape retainer 73, to attach the adhesive tape 5 to the top of the packaging bag 3, as depicted in FIG. 15.

In the above embodiment, the folder/attacher 15 is separate from the bender/sealer 14 for the purpose of increasing the cycle time. Alternatively it is possible to use a rear end closing unit of a single station including the bender/sealer 14 and the folder/attacher 15. This is effective in rendering the packaging apparatus more compact. In the above embodiment, the bag mouth 3*a* is squeezed by the transfer chucks 53 before cutting the continuous sheet material 2, and squeezed by the folder chucks 56 after transfer to the folder/attacher 15 with the transfer chucks 53. Alternatively it is possible to eliminate the transfer chucks 53. The bag mouth 3*a* may be squeezed by the folder chucks 56 before cutting the continuous sheet material 2.

It is possible to use the present invention in an apparatus of JP-B 7-41895 (corresponding to JP-A 5-330518), where a plurality of bags or packagings, having one closed end and one open end are prepared and stacked, are supplied. Furthermore, the present invention can be used for a flat bag or packaging without the gussets of the above embodiment. Note that, in FIG. 8A, the first and second bender plates 45, when open to retreat from the continuous sheet material, are directed in the upstream direction. In FIG. 10, the first and second bender plates 45, when open to retreat from the continuous sheet material, are directed in the downstream direction. Either of those constructions can be chosen for preference in preparing the packaging apparatus. It is to be noted that the first and second bender plates 45 in FIG. 8A should be combined with the third and fourth bender plates 46 having rotational axes lying on a plane near to a plane where the rotational axes of the first and second bender plates 45 lie. Alternatively the first and second bender plates 45, as shown in in FIG. 10, should be combined with the third and fourth bender plates 46 having axes lying on a plane disposed downstream from a plane where the axes of the first and second bender plates 45 lie.

Note that the first and second bender plates 45 in either of FIGS. 8A and 10 are associated with a slider mechanism (not shown) for moving the first and second bender plates 45 straight to retreat from the continuous sheet material after forming the gussets.

Furthermore the first and second bender plates 45 in either of FIGS. 8A and 10 may be associated with a slider mechanism for moving the first and second bender plates 45 straight back and forth to and from the continuous sheet material. It is possible to eliminate the swinging structure of the first and second bender plates 45. This applies to the third and fourth bender plates 46 similarly.

It is possible to use the present invention in an apparatus of JP-B 58-44525 (corresponding to JP-A 54-138792), where the continuous sheet material 2 is supplied downwards into a tube forming guide unit, and the longitudinal edges 2*b* are sealed by the center sealer arranged under them.

In the above embodiment, the inserter 38 inserts two articles 1 into the quadrangular tube to become two packaging bags 3. The quadrangular tube containing the two articles 1 is conveyed by the feed rollers 26 and the suction belt 28 to the shiftable feeder mechanism 40 intermittently by a length of each single article, prior to the cutting and sealing operation. Alternatively, the inserter 38 may operate to insert three articles, or a greater number of articles, into one longer quadrangular tube to become three or more packaging bags 3. The cutting and sealing operation may occur three or more times to follow each one operation of the inserter 38 for the insertion.

Furthermore, the inserter 38 may operate to insert two serially supplied articles 1 into the quadrangular tube to become one relatively long packaging bag. This one packaging bag may contain two articles 1 which directly contact each other in their longitudinal direction.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A tape feeder for feeding an adhesive tape to a packaging bag in which an article is contained, said tape feeder comprising:

a tape roll from which said adhesive tape is unwound;

a feed chuck unit for capturing a distal end of said adhesive tape when located in a first position, wherein said feed chuck unit is movable to a second position;

an end chuck unit for capturing a portion of said adhesive tape near said distal end when said feed chuck unit is located in said second position, wherein said feed chuck unit, when said end chuck unit captures said portion, is operative to release said distal end, and to move back to said first position; and a tape cutter, which is disposed close to said first position, for cutting said adhesive tape after said end chuck unit captures said portion, wherein said second position is located downstream of said first position, in a tape feeding direction, and said end chuck unit is located between said first position and said second position to facilitate the capture of said portion of said adhesive tape by said end chuck unit.

* * * * *